US007655373B2

(12) United States Patent
Dinh et al.

(10) Patent No.: US 7,655,373 B2
(45) Date of Patent: Feb. 2, 2010

(54) METHOD FOR IMAGING WITH IMAGING MEMBER HAVING FILLED OVERCOAT LAYER

(75) Inventors: Kenny-Tuan T. Dinh, Webster, NY (US); Timothy J. Fuller, Pittsford, NY (US); Paul J. DeFeo, Sodus Point, NY (US); Damodar M. Pai, Fairport, NY (US); John F. Yanus, Webster, NY (US); Linda L. Ferrarese, Rochester, NY (US); Cindy C. Chen, Hsin Chu (TW)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/956,804

(22) Filed: Dec. 14, 2007

(65) Prior Publication Data

US 2008/0096122 A1 Apr. 24, 2008

Related U.S. Application Data

(63) Continuation-in-part of application No. 10/868,604, filed on Jun. 14, 2004, now abandoned.

(51) Int. Cl.
*G03G 15/08* (2006.01)

(52) U.S. Cl. ..... 430/123.42; 430/119.82; 430/119.71; 430/119.72; 430/66

(58) Field of Classification Search ..... 430/119.82, 430/119.71, 119.72, 123.42
See application file for complete search history.

(56) References Cited

U.S. PATENT DOCUMENTS 3,954,466 A * 5/1976 Beatty et al. ..... 430/60
5,162,183 A * 11/1992 Lindblad et al. ..... 430/66

(Continued)

FOREIGN PATENT DOCUMENTS

EP 1 014 205 A2 6/2000
EP 1 096 322 A1 5/2001

OTHER PUBLICATIONS

"Chemical Toner Technology and The Future" to Aoka, IS&T's NIP 19 (2003), pp. 2-4.*

(Continued)

*Primary Examiner*—Christopher RoDee
(74) *Attorney, Agent, or Firm*—Pillsbury Winthrop Shaw & Pittman LLP

(57) ABSTRACT

A method for forming images including a) depositing an electrostatic latent image on a charge retentive surface of a photoreceptor member having a substrate; a charge transport layer with charge transport materials; and an overcoat layer positioned on the charge transport layer, wherein the overcoat layer includes a crosslinkable alcohol-soluble polyamide; and wherein the overcoat layer further includes additives having titanium dioxide, silica, a crosslinking agent, a deletion control agent, and a charge transport molecule; and b) applying a developer material via a development component to the charge-retentive surface to develop the electrostatic latent image to form a developed image on the charge-retentive surface, wherein the developer material comprises emulsion aggregation toner, and further wherein at least one of the additives create a texturized surface on the charge retentive surface thereby reducing the contact area between the emulsion aggregation toners and the charge retentive surface enabling increased cleaning of toners.

9 Claims, 4 Drawing Sheets

U.S. PATENT DOCUMENTS

| | | | | |
|---|---|---|---|---|
| 5,368,967 | A | 11/1994 | Schank et al. | 430/59 |
| 5,670,291 | A | 9/1997 | Ward et al. | |
| 6,071,659 | A * | 6/2000 | Renfer et al. | 430/66 |
| 6,132,913 | A | 10/2000 | Fuller et al. | 430/59 |
| 6,300,027 | B1 * | 10/2001 | Chambers et al. | 430/66 |
| 6,824,939 | B2 * | 11/2004 | Kurimoto et al. | 430/66 |
| 2004/0048178 | A1 | 3/2004 | Ikuno et al. | |
| 2004/0063016 | A1 * | 4/2004 | Fuller et al. | 430/66 |

OTHER PUBLICATIONS

English Tanslation of JP 2002-287397 (Oct. 2002).*
Database WPI, Section, CH, Week 198520, Derwent Publications Ltd. JP 60 057346 A, Canon, Apr. 3, 1985.
Database WPI, Section CH, Week 200278, Derwent Publications Ltd. JP 2002 287397 A, Ricoh, Oct. 3, 2002.
Database WPI, Section CH, Week 199039, Derwent Publications Ltd. JP 02 207 268 A, Fuji Xerox, Aug. 16, 1990.

* cited by examiner

METHOD FOR IMAGING WITH IMAGING MEMBER HAVING FILLED OVERCOAT LAYER

CROSS REFERENCE TO RELATED APPLICATIONS

This application is a Continuation-in-part of U.S. patent application Ser. No. 10/868,604, filed Jun. 14, 2004 now abandoned, entitled "Imaging Member Having Filled Overcoat Layer." The disclosure of the above-listed application is hereby incorporated herein by reference in its entirety.

BACKGROUND

Disclosed herein are imaging members, also referred to as photosensitive members, photoreceptors, photoconductors, or the like, useful in electrostatographic apparatuses, including printers, copiers, other reproductive devices, and digital apparatuses. In specific embodiments, the imaging members herein have an outer coating layer comprising at least one type of filler. In embodiments, the filled overcoat layer includes a metal filler such as silica, titanium dioxide, and mixtures thereof. The filled overcoat layer, in embodiments, provides an imaging member with longer life; improved hardness, hydrophobicity and smoothness; increased contact angle; and lower surface energy and friction. The filled overcoat layer, in embodiments, provides an imaging member that resists wear and has improved cleaning performance with small particle emulsion aggregation toners. In embodiments, the filled overcoat layer also performs well with conventional toners. In addition, the filled overcoat layer, in embodiments, adheres well to the underlying layer and is scratch resistant for up to more than 100,000 cycles. In embodiments, print quality is stable for 18,000 copies in each of the A, B, and C zones. Moreover, in embodiments, the filled overcoat layer wears 5.4 times better than a control drum in bias charging roll systems and is expected to surpass 1.7 million cycles in scorotron charging systems.

Electrophotographic imaging members, including photosensitive members, photoreceptors, photoconductors, and the like, typically include a photoconductive layer formed on an electrically conductive substrate or formed on layers between the substrate and photoconductive layer. The photoconductive layer is an insulator in the dark, so that electric charges are retained on its surface. Upon exposure to light, the charge is dissipated, and an image can be formed thereon, developed using a developer material, transferred to a copy substrate, and fused thereto to form a copy or print.

Many advanced imaging systems are based on the use of small diameter photoreceptor drums. The use of small diameter drums places a premium on photoreceptor life. A major factor limiting photoreceptor life in copiers and printers is wear. The use of small diameter drum photoreceptors exacerbates the wear problem because, for example, 3 to 10 revolutions are required to image a single letter size page. Multiple revolutions of a small diameter drum photoreceptor to reproduce a single letter size page can require up to 1 million cycles from the photoreceptor drum to obtain 100,000 prints, a desirable goal for commercial systems.

For low volume copiers and printers, bias charging rolls (BCR) are desirable because little or no ozone is produced during image cycling. However, the microcorona generated by the BCR during charging, damages the photoreceptor, resulting in rapid wear of the imaging surface, for example, the exposed surface of the charge transport layer. More specifically, wear rates can be as high as about 16 microns per 100,000 imaging cycles. Similar problems are encountered with bias transfer roll (BTR) systems.

One approach to achieving longer photoreceptor drum life is to form a protective overcoat on the imaging surface, for example, the charge transporting layer of a photoreceptor. This overcoat layer must satisfy many requirements, including transporting holes, resisting image deletion, resisting wear, and avoidance of perturbation of underlying layers during coating.

Various overcoats employing alcohol soluble polyamides have been proposed in the prior art. One of the earliest ones is an overcoat comprising an alcohol soluble polyamide without any methyl methoxy groups (ELVAMIDE®) containing N,N'-diphenyl-N,N'-bis(3-hydroxyphenyl)-(1,1'-biphenyl)-4,4'-diamine. This overcoat is described in U.S. Pat. No. 5,368,967, the entire disclosure thereof being incorporated herein by reference. Although this overcoat had very low wear rates in machines employing corotrons for charging, the wear rates were higher in machines employing BCR.

A crosslinked polyamide overcoat overcame this shortcoming. This overcoat comprised a crosslinked polyamide containing N,N'-diphenyl-N,N'-bis(3-hydroxyphenyl)-(1,1'-biphenyl)-4,4'-diamine, and referred to as LUCKAMIDE®. In order to achieve crosslinking, a polyamide polymer having N-methoxymethyl groups (LUCKAMIDE®) was employed along with a catalyst such as oxalic acid. This tough overcoat is described in U.S. Pat. No. 5,702,854, the entire disclosure thereof being incorporated herein by reference. With this overcoat, very low wear rates were obtained in machines employing bias charging rolls (BCR) and bias transfer rolls (BTR). Durable photoreceptor overcoatings containing crosslinked polyamide (i.e., LUCKAMIDE®) containing N,N'-diphenyl-N,N'-bis(3-hydroxyphenyl)-(1,1'-biphenyl)-4,4'-diamine (DHTPD) (LUCKAMIDE®-DHTPD) have been prepared using oxalic acid and trioxane to improve photoreceptor life by at least a factor of 3 to 4. Such improvement in the bias charging roll wear resistance involved crosslinking of LUCKAMIDE® under heat treatment, for example, 110° C.-120° C. for 30 minutes.

However, adhesion of this overcoat to certain photoreceptor charge transport layers, containing certain polycarbonates (e.g., Z-type 300) and charge transport materials such as bis-N,N-(3,4-dimethylphenyl)-N-(4-biphenyl)amine and N,N'-diphenyl-N,N'-bis(3-methylphenyl)-(1,1'-biphenyl)-4,4'-diamine, is greatly reduced under some drying conditions. On the other hand, under drying conditions of below about 110° C., the overcoat adhesion to the charge transport layer was good, but the overcoat had a high rate of wear. Thus, there was an unacceptably small drying condition window for the overcoat to achieve the targets of both adhesion and wear rate.

U.S. Pat. No. 5,702,854 to Schank, et al. discloses an electrophotographic imaging member including a supporting substrate coated with at least a charge generating layer, a charge transport layer and an overcoating layer. The overcoating layer comprises a dihydroxy arylamine dissolved or molecularly dispersed in a crosslinked polyamide matrix. The overcoating layer is formed by crosslinking a crosslinkable coating composition including a polyamide containing N-methoxy methyl groups attached to amide nitrogen atoms, a crosslinking catalyst and a dihydroxy amine, and heating the coating to crosslink the polyamide.

U.S. Pat. No. 5,681,679 issued to Schank, et al. discloses a flexible electrophotographic imaging member including a supporting substrate and a resilient combination of at least one photoconductive layer and an overcoating layer. The at least one photoconductive layer comprises a hole transporting arylamine siloxane polymer and the overcoating comprising a crosslinked polyamide doped with a dihydroxy amine.

U.S. Pat. No. 6,132,913 to Fuller et al. discloses a photoreceptor crosslinkable coating composition including an alcohol-soluble acrylated polyamide containing alkoxymethyl or alkoxyalkylmethyl groups attached to amide nitrogen atoms, a crosslinking catalyst and a mixture of a hydroxy functionalized aromatic diamine with a hydroxy functionalized triarylamine.

U.S. Pat. No. 6,071,659 to Renfer, et al. discloses an imaging member including an overcoat layer having a hole transporting hydroxy arylamine compound having at least two hydroxy functional groups, bis-(2-methyl-4-diethylaminophenyl)-phenylmethane and a crosslinked polyamide film forming binder.

U.S. Pat. No. 6,004,709, issued to Renfer et al. discloses an allyloxypolyamide composition. The allyloxypolyamide is represented by a specific formula. The allyloxypolyamide may be synthesized by reacting an alcohol soluble polyamide with formaldehyde and an allylalcohol.

U.S. Pat. No. 5,976,744 issued to Fuller et al. discloses an electrophotographic imaging member including a supporting substrate coated with at least one photoconductive layer, and an overcoating layer. The overcoating layer includes hydroxy functionalized aromatic diamine and a hydroxy functionalized triarylamine dissolved or molecularly dispersed in a crosslinked acrylated polyamide matrix. The hydroxy functionalized triarylamine is a compound different from the polyhydroxy functionalized aromatic diamine.

U.S. Pat. No. 5,709,974 issued to Yuh, et al. discloses an electrophotographic imaging member including a charge generating layer, a charge transport layer and an overcoating layer. The transport layer includes a charge transporting aromatic diamine molecule in a polystyrene matrix. The overcoating layer includes a hole transporting hydroxy arylamine compound having at least two hydroxy functional groups, and a polyamide film forming binder capable of forming hydrogen bonds with the hydroxy functional groups of the hydroxy arylamine compound.

U.S. Pat. No. 5,368,967 issued to Schank et al. discloses an electrophotographic imaging member comprising a substrate, a charge generating layer, a charge transport layer, and an overcoat layer comprising a small molecule hole transporting arylamine having at least two hydroxy functional groups, a hydroxy or multihydroxy triphenyl methane, and a polyamide film forming binder capable of forming hydrogen bonds with the hydroxy functional groups such as the hydroxy arylamine and hydroxy or multihydroxy triphenyl methane. This overcoat layer may be fabricated using an alcohol solvent. This electrophotographic imaging member may be used in an electrophotographic imaging process. Specific materials including ELVAMIDE® polyamide and N,N'-diphenyl-N,N'-bis(3-hydroxyphenyl)-(1,1'-biphenyl)-4,4'-diamine and bis-[2-methyl-4-(N-2-hydroxyethyl-N-ethyl-aminophenyl)]-phenylmethane are disclosed in this patent.

U.S. Pat. No. 4,871,634 to Limburg et al. discloses an electrostatographic imaging member containing at least one electrophotoconductive layer. The imaging member comprises a photogenerating material and a hydroxy arylamine compound represented by a certain formula. The hydroxy arylamine compound can be used in an overcoat with the hydroxy arylamine compound bonded to a resin capable of hydrogen bonding such as a polyamide possessing alcohol solubility.

U.S. Pat. No. 4,297,425 to Pai, et al. discloses a layered photosensitive member comprising a generator layer and a transport layer containing a combination of diamine and triphenyl methane molecules dispersed in a polymeric binder.

U.S. Pat. No. 4,050,935 to Limburg et al. discloses a layered photosensitive member comprising a generator layer of trigonal selenium and a transport layer of bis(4-diethylamino-2-methylphenyl)phenylmethane molecularly dispersed in a polymeric binder.

U.S. Pat. No. 4,457,994 to Pai, et al. discloses a layered photosensitive member comprising a generator layer and a transport layer containing a diamine type molecule dispersed in a polymeric binder, and an overcoat containing triphenyl methane molecules dispersed in a polymeric binder.

U.S. Pat. No. 4,281,054 to Horgan, et al., discloses an imaging member comprising a substrate, an injecting contact or hole injecting electrode overlying the substrate, a charge transport layer comprising an electrically inactive resin containing a dispersed electrically active material, a layer of charge generator material, and a layer of insulating organic resin overlying the charge generating material. The charge transport layer can contain triphenylmethane.

U.S. Pat. No. 4,599,286 to Limburg et al. discloses an electrophotographic imaging member comprising a charge generation layer and a charge transport layer. The transport layer comprises an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

U.S. Pat. No. 5,418,107 to Nealey, et al. discloses a process for fabricating an electrophotographic imaging member.

Problems have resulted from the use of polyamide overcoats, including reduced wear of the photoreceptor overcoat. Use of improved small particle emulsion aggregation toners have caused an additional cleaning problem. More specifically, current overcoats suffer from high friction against emulsion aggregation toners and cleaning blades. As a result, such emulsion aggregation toners are difficult to remove from the surface of current overcoats using known cleaning blades fixtures. The photoreceptor overcoat described herein is loaded with low surface energy inorganic oxides which, in embodiments, create a texturized surface on the photoreceptor overcoat. The textured layer, in embodiments, reduces the contact area between toners and overcoat surface, thereby allowing toners to be easily removed by cleaning blades.

SUMMARY

Embodiments of the present invention include a method for forming images including a) depositing an electrostatic latent image on a charge retentive surface of a photoreceptor member having a substrate; a charge transport layer with charge transport materials dispersed therein; and an overcoat layer positioned on the charge transport layer, wherein the overcoat layer includes a crosslinkable alcohol-soluble polyamide having the following Formula II,

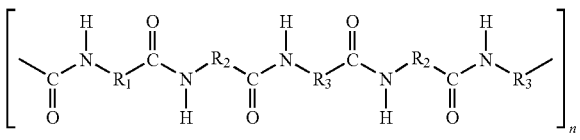

wherein $R_1$, $R_2$ and $R_3$ are the same or different and are alkyl groups containing from about 1 to about 15 carbon atoms, and wherein n is a number of from about 50 to about 1,000; and wherein the overcoat layer further includes additives of titanium dioxide, silica, a crosslinking agent, a deletion control agent, and a charge transport molecule; and b) applying a developer material via a development component to the charge-retentive surface to develop the electrostatic latent image to form a developed image on the charge-retentive surface, wherein the developer material comprises emulsion aggregation toner, and further wherein at least one of the additives creates a texturized surface on the charge retentive surface thereby reducing a contact area between the emulsion aggregation toners and the charge retentive surface thereby enabling increased cleaning of the emulsion aggregation toners.

BRIEF DESCRIPTION OF THE DRAWINGS

For a better understanding of the present invention, reference may be had to the accompanying figure.

DETAILED DESCRIPTION

Disclosed herein are filled overcoat layers for imaging members, photoreceptors, photoconductors, or photosensitive members in an electrostatographic apparatus. In embodiments, the present filled overcoat photoreceptor can be used in printing machines.

Figure 1:
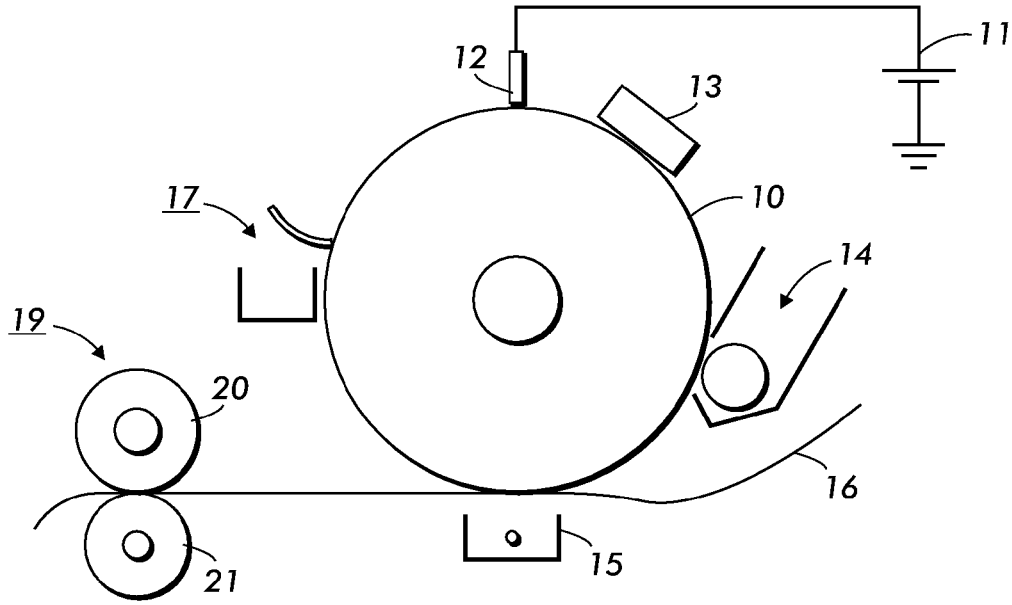
FIG. 1 is an illustration of a general electrostatographic apparatus using a photoreceptor member.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of an electrical charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. In embodiments, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Fusing may be accomplished by other fusing members such as a fusing belt in pressure contact with a pressure roller, fusing roller in contact with a pressure belt, or other like systems. Photoreceptor 10, subsequent to transfer, advances to cleaning station 17, wherein any toner left on photoreceptor 10 is cleaned there from by use of a blade 22 (as shown in FIG. 1), brush, or other cleaning apparatus.

Figure 2:
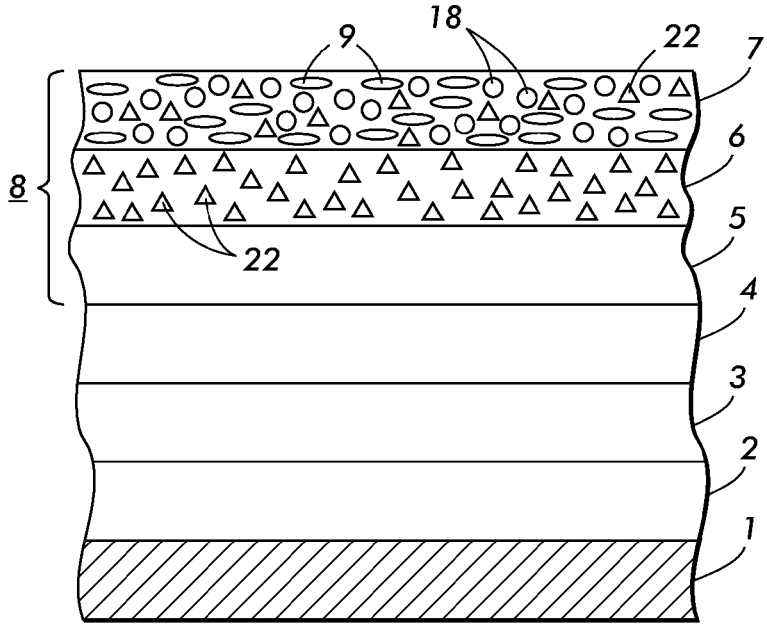
FIG. 2 is an illustration of an embodiment of a photoreceptor showing various layers.

Electrophotographic imaging members are well known in the art. Electrophotographic imaging members may be prepared by any suitable technique. Referring to FIG. 2, typically, a flexible or rigid substrate 1 is provided with an electrically conductive surface or coating 2.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating 2. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, or from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer 3 may be applied to the substrate 1 or coating. Any suitable and conventional blocking layer capable of forming an electronic barrier to holes between the adjacent photoconductive layer 8 (or electrophotographic imaging layer 8) and the underlying conductive surface 2 of substrate 1 may be used.

An optional adhesive layer 4 may be applied to the hole-blocking layer 3. Any suitable adhesive layer well known in the art may be used. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

At least one electrophotographic imaging layer 8 is formed on the adhesive layer 4, blocking layer 3 or substrate 1. The electrophotographic imaging layer 8 may be a single layer (7 in FIG. 2) that performs both charge-generating and charge transport functions as is well known in the art, or it may comprise multiple layers such as a charge generator layer 5, charge transport layer 6, and overcoat layer 7.

The charge generating layer 5 can be applied to the electrically conductive surface, or on other surfaces in between the substrate 1 and charge generating layer 5. A charge blocking layer or hole-blocking layer 3 may optionally be applied to the electrically conductive surface prior to the application of a charge generating layer 5. If desired, an adhesive layer 4 may be used between the charge blocking or hole-blocking layer 3 and the charge generating layer 5. Usually, the charge generation layer 5 is applied onto the blocking layer 3 and a charge transport layer 6, is formed on the charge generation layer 5. This structure may have the charge generation layer 5 on top of or below the charge transport layer 6, and overcoat layer 7 on top of the charge transport layer 6.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge-generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film forming binder material may be employed as the matrix in the charge-generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be used to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer 6 may comprise a charge transporting small molecule 22 dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. However, to avoid cycle-up in machines with high throughput, the charge transport layer should be substantially free (less than about two percent) of di or triamino-triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

Any suitable electrically inactive resin binder insoluble in the alcohol solvent used to apply the overcoat layer may be employed in the charge transport layer of this invention. Typical inactive resin binders include polycarbonate resin, polyester, polyarylate, polyacrylate, polyether, polysulfone, and the like. Molecular weights can vary, for example, from about 20,000 to about 150,000. Examples of binders include polycarbonates such as poly(4,4'-isopropylidene-diphenylene) carbonate (also referred to as bisphenol-A-polycarbonate, poly(4,4'-cyclohexylidinediphenylene)carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge transporting polymer may also be used in the charge transporting layer of this invention. The charge transporting polymer should be insoluble in the alcohol solvent employed to apply the overcoat layer of this invention. These electrically active charge transporting polymeric materials should be capable of supporting the injection of photogenerated holes from the charge generation material and be capable of allowing the transport of these holes therethrough.

Any suitable and conventional technique may be used to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

In embodiments, an overcoat layer 7 is coated on the charge transporting layer 6. In embodiments, a polyamide resin is used as the resin in the overcoat layer. In embodiments, the polyamide is an alcohol-soluble polyamide. In embodiments, the polyamide comprises pendant groups selected from the group consisting of methoxy, ethoxy and hydroxy pendant groups. In embodiments, the pendant groups are methylene methoxy pendant groups. In embodiments, the polyamide has the following Formula II:

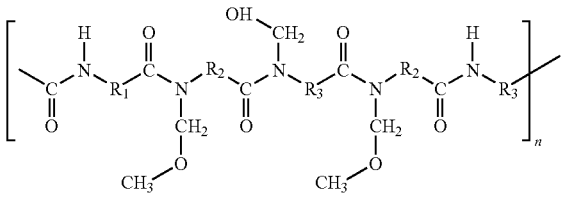

wherein $R_1$, $R_2$ and $R_3$ are alkyl groups having from about 1 to about 15 carbons, or from about 1 to about 10 carbons, or from about 1 to about 5 carbons, such as methyl, ethyl, propyl, butyl, and the like, and n is a number of from about 50 to about 1,000, or from about 150 to about 500, or about 270. Typical commercially available alcohol-soluble polyamide polymers suitable for use herein include those sold under the trade names LUCKAMIDE® 5003 from Dai Nippon Ink, NYLON® 8, CM4000® and CM8000® both from Toray Industries, Ltd., and other polyamides such as those prepared according to the method described in Sorenson and Campbell, "Preparative Methods of Polymer Chemistry," second edition, pg. 76, John Wiley & Sons, Inc., 1968, and the like, and mixtures thereof. In embodiments, the polyamide has methoxy, ethoxy and hydroxy groups, including N-methoxymethyl, N-ethoxymethyl, and N-hydroxymethyl pendant groups. Other polyamides useful herein include those set forth and disclosed in U.S. Pat. Nos. 6,132,913 and 6,071,659, the entire disclosures being hereby incorporated by reference.

Other examples of suitable polyamides include those such as the ELVAMIDE® from DuPont de Nemours & Company. These do not contain methoxy methyl groups attached to the nitrogen atoms of the amide groups in the polymer backbone. An example of ELVAMIDE® has the following Formula II:

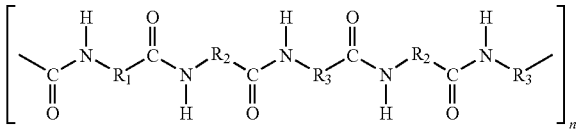

wherein $R_1$, $R_2$ and $R_3$ are the same or different and can be alkyl groups having from about 1 to about 15 carbons, or from about 1 to about 10 carbons, or from about 1 to about 5 carbons, such as methyl, ethyl, propyl, butyl, and the like, and n is a number of from about 50 to about 1,000, or from about 150 to about 500, or about 270. In embodiments, $R_1$, $R_2$ and $R_3$ in Formula II are alkylene groups containing less than about 6 carbon atoms and comprise between about 20 to about 60 percent of the total number of alkyl groups. ELVAMIDE® can be chemically modified by reaction with paraformaldehyde and acrylic acid to form acryloxy-methyl modified ELVAMIDE®.

The polyamide is present in the overcoat layer in an amount of from about 20 to about 90 percent, or from about 40 to about 60 percent by weight of total solids.

A deletion control agent (9 in FIG. 2) can be present in the overcoat layer. The deletions can occur due to the oxidation effects of the corotron or bias charging roll (BCR) effluents that increases the conductivity of the photoreceptor surface. The present deletion control agents minimize this conductivity change. A class of known deletion control agents that have been effective with some hole transporting compositions include triphenyl methanes with nitrogen containing substituents such as bis-(2-methyl-4-diethylaminophenyl)-phenylmethane and the like. Other deletion control agents include, for example, hindered phenols such as butylated hydroxy toluene and the like.

However, the above deletion control agents do not allow for effective deletion control when used with polyamide-based hold transporting layers. The problem is escalated when the photoreceptor is used in a high-speed machine that uses charging corotrons, and when a highly wear resistant layer allows the buildup of the conductive oxidized species. Deletion control molecules like tetrakis methylene (3,5-di-tert-butyl-4-hydroxy hydrocinnamate) methane [Irganox 1010], butylated hydroxytoluene (BHT), bis(4-diethylamino-2-methylphenyl)phenylmethane (BDETPM), bis-[2-methyl-4-(N-2-hydroxyethyl-N-ethyl-aminophenyl)]-phenylmethane, bis (diethylamino)triphenyl methane, bis-(2-methyl-4-diethylaminophenyl)-phenylmethane, and mixtures thereof, and the like, have been added to the charge transport layer with arylamine charge transporting species. However, in the case of the polyamide based overcoat, these known deletion control additives have proven inadequate. Deletion is most apparent in the polyamide overcoat because of its extreme resistance to wear (10 nm/kilocycle with BCR and 4 nm/kilocycle with scorotron charging). Because the oxidized surface does not wear off appreciably, deletion from polyamide overcoats is more apparent than in polycarbonate charge transport layers, where the greater wear rates continually refresh the photoconductor surface.

The deletion control compound can be present in the polyamide overcoat in an amount of from about 5 to about 40 percent, or from about 10 to about 30 percent, or from about 15 to about 20 percent by weight of total solids.

A charge transport molecule 22 or a charge control agent 22 can be present in the outer overcoat layer in addition to the deletion control molecule(s). Examples include N,N'-diphenyl-N,N'-bis(3-hydroxyphenyl)-[1,1'-biphenyl]-4-4'-diamine (DHTBD), PTAP (N-[3-hydroxyphenyl]-N-[4-methylphenyl]-N-phenylamine), DTAP (N-[3-hydroxyphenyl]-N,N-bis[4-methylphenyl]amine), or the like. The charge transport molecules can be present in the overcoat layer in an amount of from about 50 to about 99 percent, or from about 30 to about 90 percent or from about 60 to about 80 percent by weight of total solids.

Crosslinking agents can be used in combination with the overcoat to promote crosslinking of the polymer, such as the polyamide, thereby providing a strong bond. Examples of suitable crosslinking agents include oxalic acid, trioxane, p-toluene sulfonic acid, phosphoric acid, sulfuric acid, Cymel 303 (hexamethoxymethylmelamine available from the Cytec Industries Inc.), and the like, and mixtures thereof. In embodiments, the crosslinking agent is oxalic acid. The crosslinking agent can be used in an amount of from about 1 to about 20 percent, or from about 5 to about 10 percent, or about 8 to about 9 percent by weight of total polymer content.

An additional filler 18, such as an inorganic material such as an inorganic oxide, can be added to the overcoat layer. The addition of the filler provides improved wear and improved cleaning, especially for use with small particle emulsion aggregation toners. Examples of suitable fillers include inorganic oxide such as $TiO_2$, silica, $ZrO_2$, ZnO or $SnO_2$ and the like. The inorganic oxide can be present in the overcoat layer in an amount of from about 20 to about 70, or from about 30 to about 60 percent by weight of total solids in the overcoat layer.

The inorganic oxide disperses very well into the polyamide, especially the LUCKAMIDE®. Also, the polyamide acts as an adhesion promoter to increase the overcoat adhesion to more than 15 g/cm.

More than one kind of polyamide may be used in the outer layer. For example, both ELVAMIDE® and LUCKAMIDE® can be used, or a combination of these and/or other polyamides. If both ELVAMIDE® and LUCKAMIDE® are used, ELVAMIDE® is incompatible with LUCKAMIDE® binder and is dispersed as small spheres of less than 0.3 micrometers diameter.

The formed overcoat layer is smooth, having an Ra of from about 0.01 to about 0.1, or from about 0.04 to about 0.06 microns throughout life.

The contact angle of the outer layer is from about 85 to about 95, or from about 89 to about 91° throughout life.

The friction between the toner, such as the emulsion aggregation toner is very low as compared to known charge transport layers.

The thickness of the continuous overcoat layer selected depends upon the abrasiveness of the charging (e.g., bias charging roll), cleaning (e.g., blade or web), development (e.g., brush), transfer (e.g., bias transfer roll), etc., in the system employed and can range up to about 20 micrometers. In embodiments, the thickness is from about 1 micrometer and about 20 micrometers, or from about 3 to about 15 micrometers. Any suitable and conventional technique may be used to mix and thereafter apply the overcoat layer coating mixture to the charge-generating layer. Typical application techniques include spraying, dip coating, roll coating, wire wound rod coating, and the like. Drying of the deposited coating may be effected by any suitable conventional technique such as oven drying, infrared radiation drying, air drying, and the like. The dried overcoating of this invention should transport holes during imaging and should not have too high a free carrier concentration. Free carrier concentration in the overcoat increases the dark decay. In embodiments, the dark decay of the overcoated layer should be about the same as that of the unovercoated device.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Preparation of Photoreceptor without Overcoat Layer

Electrophotographic imaging members were prepared by dip coating a charge blocking layer on a rough surface of 17 aluminum drums having a diameter of 3 cm and a length of 31 cm. The blocking layer coating mixture was a solution of 8 weight percent polyamide (nylon 6) dissolved in a 92 weight percent butanol, methanol and water solvent mixture. The butanol, methanol and water mixture percentages were 55, 36 and 9 percent by weight, respectively. The coating was applied at a coating bath withdrawal rate of about 30 cm/minute. After drying in a forced air oven, each blocking layers had a thickness of 1.5 micrometers. The dried blocking layers were coated with a charge generating layer containing 2.5 weight percent hydroxyl gallium phthalocyanine pigment particles, 2.5 weight percent polyvinylbutyral binder polymer and 95 weight percent cyclohexanone solvent. The coatings were applied at a coating bath withdrawal rate of about 30 cm/minute. After drying in a forced air oven, each charge-generating layer had a thickness of 0.2 micrometer. The drums were subsequently coated with charge transport layers containing N,N'-diphenyl-N,N'-bis(3-methylphenyl)-1,1;-biphenyl-4,4'-diamine dispersed in polycarbonate binder (PcZ400). The charge transport coating mixture consisted of 8 weight percent N,N'-diphenyl-N,N'-bis(3-methylphenyl)-1,1;-biphenyl-4,4'-diamine, 12 weight percent binder and 80 weight percent monochlorobenzene solvent. The dried thickness of each transport layer was 20 micrometers.

Example 2

Preparation of Photoreceptor with Overcoat Layer Thereon

Several drums from Example 1 were overcoated with a protective layer coating solution. The composition was prepared as follows: 0.7 grams polyamide containing methoxymethyl groups (Luckamide® 5003 available from Dai Nippon Ink), 0.3 grams ELVAMIDE® 8063 (available from E.I. Dupont), methanol (3.5 grams) and 1-propanol (3.5 grams) were all combined in a 2 ounce amber bottle and warmed with magnetic stirring in a water bath at about 60° C. A solution formed within 30 minutes. This solution was then allowed to cool to 25° C. Next, 0.08 grams oxalic acid was added and the mixture was warmed to 40° C. Subsequently, 0.9 grams N,N'-diphenyl-N,N'-bis(3-hydroxyphenyl)-[1,1'-biphenyl]-4,4'-diamine (DHTPD) was added and stirred until a complete solution was formed. A separate solution containing 0.08 grams Cymel®303 (hexamethoxymethylmelamine available from the Cytec Industries Inc.) and 0.2 grams bis (4-diethylamino-2-methylphenyl)-4-methoxyphenylmethane and one gram tetrahydrofuran was formed and added to the polymer solution. An amount of 0.45 grams $TiO_2$ (MT 400), 0.05 grams silica (Aerosil R104) and 20 grams of 3 mm diameter glass beads were then added.

The 2 ounce amber bottle was roll-milled for four consecutive days. The well-mixed dispersion of $TiO_2$-silica overcoat was then filtered using a 0.5 micron filter. A 6-micrometer thick overcoat was applied in the dip coating apparatus with a pull rate of 250 millimeters/min. The overcoated drum was dried at 120° C. for 35 minutes.

Example 3

Print Testing of Photoreceptors from Above Examples

Figure 5:
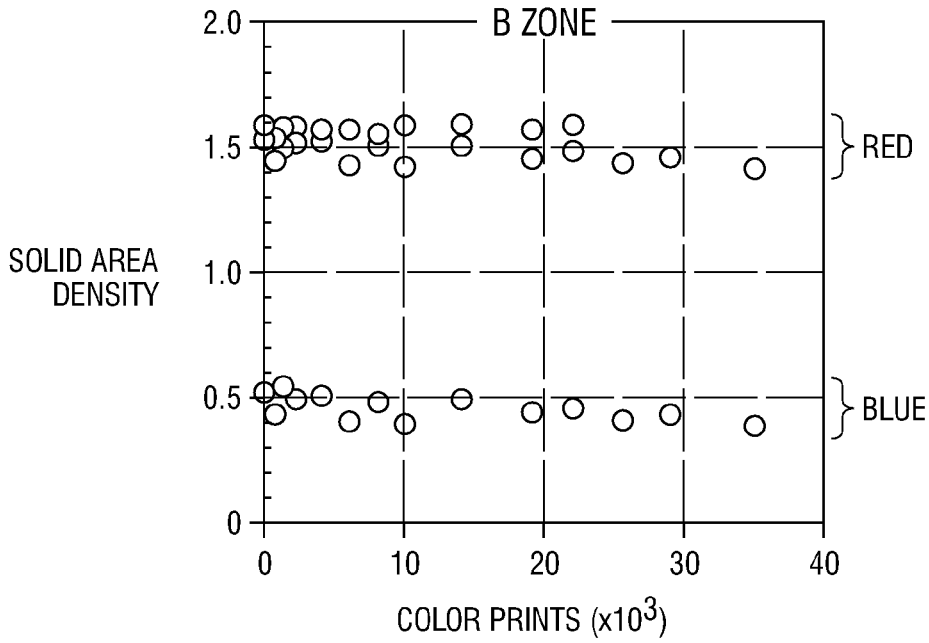
FIG. 5 is a graph showing density of full color and half-tone patterns in Zone B as a function of number of color prints.

One drum from Example 1 (standard photoreceptor without overcoat layer) and one drum from Example 2 (photoreceptor with overcoat) were print tested using a Xerox Docucolor 12/50 copy machine in a B-zone condition with 72° F. and 50% humidity. A total of 4,000 consecutive color prints were produced every day for 3 days. Prints were collected at various time intervals for analysis. Using a Macbeth Spectrodensitometer, solid area density of collected prints was measured. The results shown in FIG. 5 illustrate that the $TiO_2$-silica overcoat preserves color quality and image quality of all 16,000 color prints and that there is no significant difference in color quality and image quality between the overcoat and standard photoreceptor.

Example 4

Print Testing of Photoreceptors from Above Examples

Figure 4:
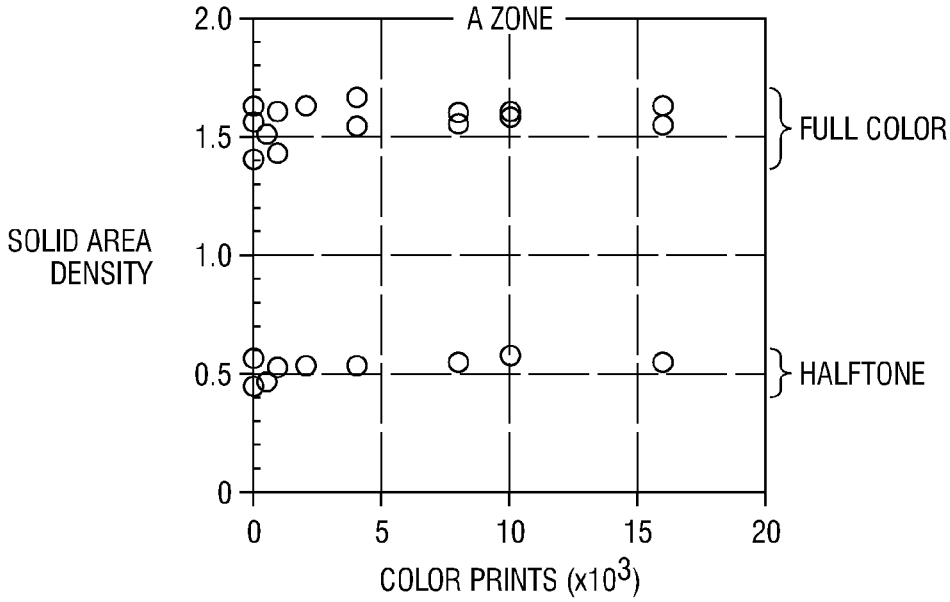
FIG. 4 is a graph showing density of full color and half-tone patterns in Zone A as a function of number of color prints.

One drum from Example 1 (standard photoreceptor without overcoat layer) and one drum from Example 2 (overcoated photoreceptor) were print tested using a Xerox Docucolor 12/50 copy machine in an A-zone condition with 80° F. and 85% humidity. A total of 4,000 consecutive color prints were produced every day for 3 days for a total of 16,000 prints. Prints were collected at various time intervals for analysis. Using a Macbeth Spectrodensitometer, solid area density of collected prints was measured. The results shown in FIG. 4 illustrate that the $TiO_2$-silica overcoat preserves color quality and image quality of all 16,000 color prints and that there is no significant difference in color quality and image quality between the inventive overcoat and standard photoreceptor.

Example 5

Print Testing of Photoreceptors from Above Examples

Figure 6:
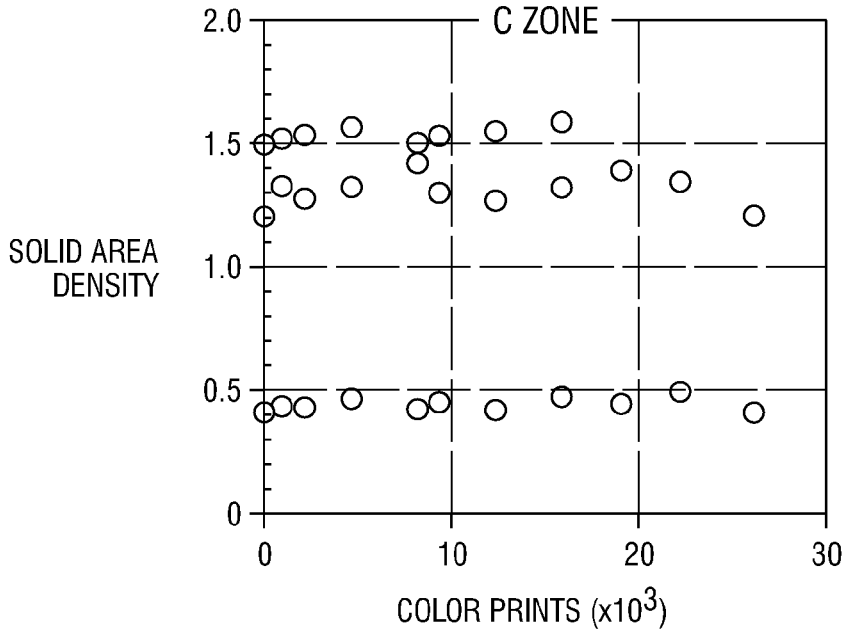
FIG. 6 is a graph showing density of full color and half-tone patterns in Zone C as a function of number of color prints.

One drum from Example 1 (standard photoreceptor without overcoat layer) and one drum from Example 2 (overcoated photoreceptor) were print tested using a Xerox Docucolor 12/50 copy machine in a C-zone condition with 15° F. and 52% humidity. A total of 4,000 consecutive color prints were produced every day for 3 days for a total of 16,000 prints. Prints were collected at various time intervals for analysis. Using a Macbeth Spectrodensitometer, solid area density of collected prints was measured. The results shown in FIG. 6 illustrate that the $TiO_2$-silica overcoat preserves color quality and image quality of all 16,000-color prints and that there is no significant difference in color quality and image quality between the inventive overcoat and standard photoreceptor.

Example 6

Wear Rate Testing of Photoreceptors from Above Examples using Bias Charging Roller The photoreceptor without an overcoat of Example 1 and the overcoated drum of Example 2 above were tested for wear rate in a wear fixture that contained a bias charging roll for charging. Wear rate was calculated in terms of nanometers/kilocycles of rotation (nm/Kc). Reproducibility of calibration standards was about .+−.2 nm/Kc. The wear of the drum without the overcoat of Example 1 was about 65 nm/Kc. Wear of the overcoated drums of Example 2 was between 12 and 15 nm/Kc. As a result, the photoreceptor with 6 micron thick overcoat would produce 500,000 rotational cycles, which should be about 4 times more than the number of rotational cycles that the drum with no overcoat from Example 1 would produce.

Example 7

Wear Rate Testing of Photoreceptors from Above Examples using Scorotron

The drum of Example 1 with no overcoat and the overcoated drum of Example 2 were tested for wear rate in a wear fixture that contained a scorotron charging system. Wear rate was calculated in terms of nanometers/kilocycles of rotational cycle (nm/kc). Wear rate of the drum without the overcoat from Example 1 was about 15 nm/kc, whereas that of the overcoated drums of Example 2 was between 3 nm/kc and 5 nm/kc. As a result, the photoreceptor with 6-micron thick overcoat would produce 1.7 million rotational cycles, which should be about 2-3 times more than the number of rotational cycles that the drum with no overcoat from Example 1 would produce.

Example 8

Adhesion Testing of Overcoated Photoreceptors

An overcoated drum of Example 2 was tested for adhesion of charge transport layer to overcoat layer using a modified FINAT tensile tester capable of peeling a laminate through an angle of 150° at a jaw separation rate of 300 mm per minute and with an accuracy of ±2%. A strip of standard tape of about 1 inch by 8 inches was applied to the surface of overcoat layer which had been slightly peeled from the charge transport layer at one end. The overcoat layer can be stripped away from the charge transport layer at an angle of peel of 150°. The final result of released force expressed in g/cm per one inch width at 300 mm/min peeling rate was the average of five or more readings at 2 inches intervals. A moderate adhesion of 20 g/cm was the average reading of the overcoated drum obtained from Example 2.

Example 9

Contact Angle Testing of Photoreceptors from Above Examples

The contact angles of water on device surfaces were measured at ambient temperature, about 23° C., using Contact Angle System OCA (Dataphysics Instruments GmbH, model OCA15). Deionized water was used as liquid phase. At least ten measurements were performed and their average was recorded for each device. The device from Example 2 had an average contact angle of 98-100° compared with an average contact angle of 89-91° for the device of Example 1. The surface energies calculated from the Equation of State $$2\cdot\left(\frac{\gamma_{sv}}{\gamma_{lv}}\right)^{1/2}\cdot\exp[-\beta(\gamma_{lv}-\gamma_{sv})^2]=1+\cos\theta$$

are 22-24 erg.cm$^{-2}$ for the device from example 2 and 28-30 erg.cm$^{-2}$ for the device from Example 1, respectively, where $\gamma_{sv}$ and $\gamma_{lv}$ are the surface energies of solid surface and liquid surface, respectively, θ is the contact angle, and β is a constant. Generally, lower surface energy enables easier toner transfer and cleaning.

Example 10

Friction Testing of Photoreceptors from Above Examples

One drum from each of Example 1 and 2 was tested for friction between Emulsion Aggregation (EA) toners and either the surface of overcoat layer from the overcoated device of Example 2 or the surface of charge transport layer from the photoreceptor with no overcoat from Example 1. Friction was measured using a friction tester type RPG from Wazau Corporation. During the test process, a sliding block with EA toners attaching to the surface moved at a certain velocity against the resistance of the device's surface. A force meter measured the magnitude of the friction force generated. Also, the friction between EA toners and overcoat layer was much lower than charge transport layer from Example 2.

Example 11

Charge Testing of Photoreceptors from Above Examples

Figure 3:
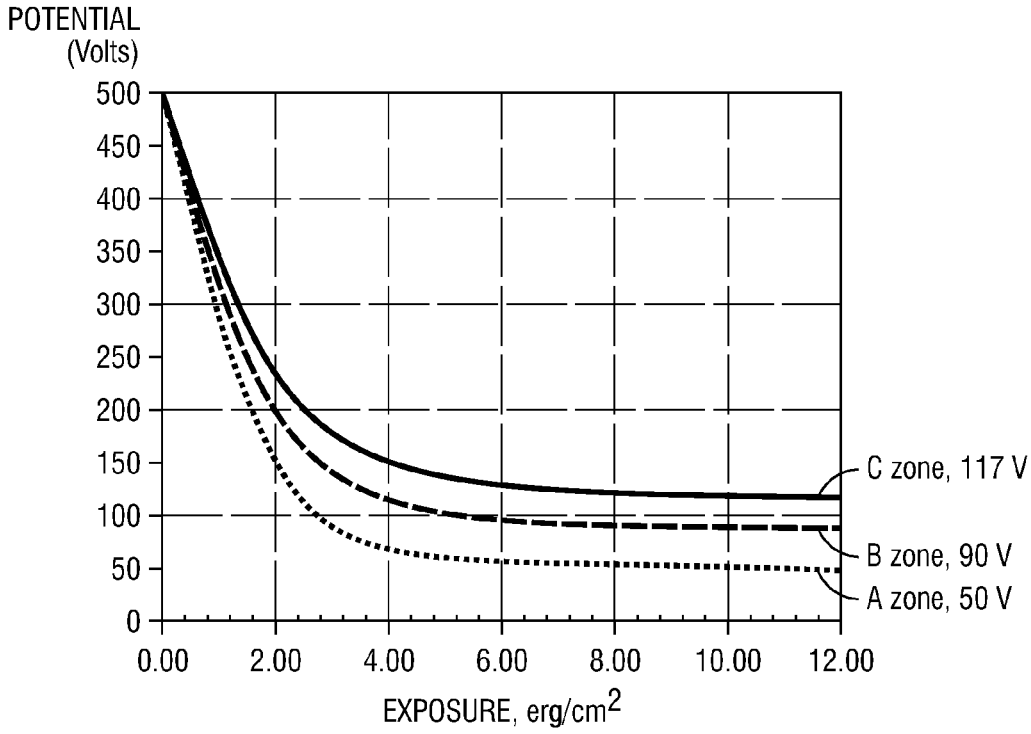
FIG. 3 is a graph of PIDC (Photo Induced Discharge Characteristics) voltage versus exposure in erg/cm$^2$.

Each device from Example 1 and 2 was mounted in a xerographic scanner. Xerographic scanners are well known in the industry and consist of a means to rotate the sample while it is electrically charged and discharged. The charge on the sample is monitored through the use of electrostatic probes placed at precise positions around the circumference of the device. The samples were charged to a negative potential 500 volts. As the device rotated the initial charging potential was measured by voltage probe 1. The sample was then exposed to monochromatic radiation of known intensity and the surface potential measured by voltage probes 2 and 3. Finally, the sample was exposed to an erase lamp of appropriate intensity and wavelength and any residual potential was measured by voltage probe 4. The process was repeated under the control of the xerographic scanners computer and the data stored. The PIDC (photo induced discharge curve) was obtained by plotting the potentials at voltage probes 2 and 3 as a function of the light energy. The samples charge acceptance and dark decay were also determined from the scanner data. The PIDC was measured under three different environmental conditions, e.g., A zone (80° F., 85% humidity), B zone (72° F., 50% humidity) and C zone (15° F., 52% humidity) and are shown in FIG. 3.

Example 12

Charge Testing of Photoreceptors from Above Examples

Figure 7:
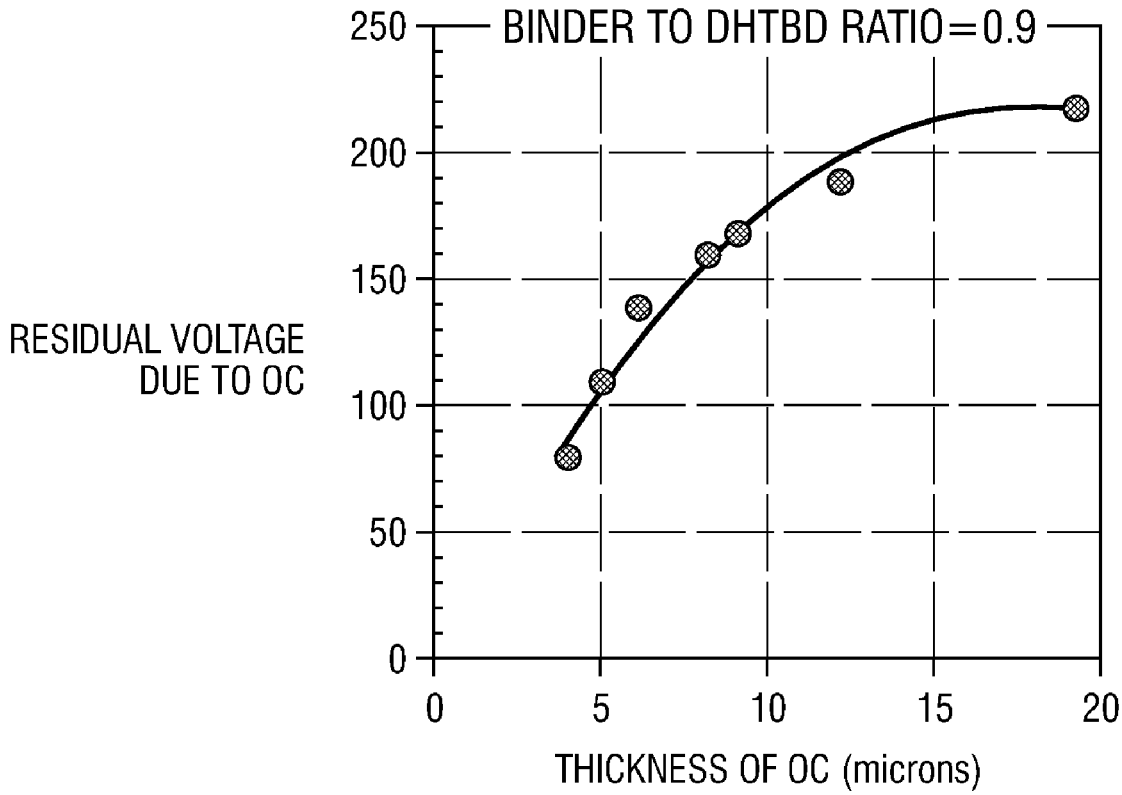
FIG. 7 is a graph showing the effects of overcoat thickness on wear rate and residual voltage.

Several drums from Example 1 were overcoated with an overcoat solution as described in Example 2. Different pull rates were applied to the overcoat coating process to obtain a range of overcoat thickness from 4 microns to 19 microns. These drums were then measured for PIDCs as described in Example 11. FIG. 7 shows an effect of thickness on residual voltage due to the presence of overcoat layer. Too thick of an overcoat could eventually reduce the image quality due to the high residual voltage.

While the invention has been described in detail with reference to specific and embodiments, it will be appreciated that various modifications and variations will be apparent to the artisan. All such modifications and embodiments as may readily occur to one skilled in the art are intended to be within the scope of the appended claims.

What is claimed is:

1. A method for forming images on a photoreceptor comprising:

a) depositing an electrostatic latent image on a surface of a photoreceptor comprising a substrate; a charge transport layer comprising charge transport materials dispersed therein; and an overcoat layer positioned on said charge transport layer, wherein said overcoat layer has an Ra of from about 0.01 to about 0.1 μm and comprises a crosslinkable alcohol-soluble polyamide in an amount of from about 20 percent to about 90 percent of total solids and having the following Formula II,

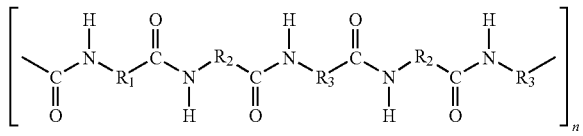

wherein $R^1$, $R^2$ and $R^3$ are the same or different and are alkyl groups containing from about 1 to about 15 carbon atoms, and wherein n is a number of from about 50 to about 1,000; and wherein said overcoat layer further comprises additives comprising titanium dioxide, silica, a crosslinking agent, a deletion control agent, and a charge transport molecule present in the overcoat layer; and b) applying a developer material via a development component to said photoreceptor surface to develop said electrostatic latent image to form a developed image on said photoreceptor surface, wherein said developer material comprises emulsion aggregation toner, and further wherein at least one of said additives creates a texturized surface on said photoreceptor surface, and wherein said titanium dioxide and silica reduce a contact area between said emulsion aggregation toners and said photoreceptor surface thereby enabling increased cleaning of said emulsion aggregation toners and wherein a contact angle of the outer layer is from about 85 to 91°.

2. A method in accordance with claim 1, wherein said crosslinking agent is selected from the group consisting of oxalic acid, trioxane, p-toluene sulfonic acid, phosphoric acid, sulfuric acid, hexamethoxymethylmelamine, and mixtures thereof.

3. A method in accordance with claim 1, wherein said deletion control agent is selected from the group consisting of tetrakis methylene (3,5-di-tert-butyl-4-hydroxy hydrocinnamate) methane, butylated hydroxytoluene, bis-[2-methyl-4-(N-2-hydroxyethyl-N-ethyl-aminophenyl)]-phenylmethane, bis(4-diethylamino-2-methylphenyl) phenylmethane, bis(diethylamino) triphenyl methane, and mixtures thereof.

4. A method in accordance with claim 1, wherein said titanium dioxide ispresent in said overcoat layer in an amount of from about 20 to about 70 percent by weight of total solids.

5. A method in accordance with claim 4, wherein said titanium dioxide ispresent in said overcoat layer in an amount of from about 30 to about 60 percent by weight of total solids.

6. A method in accordance with claim 1, wherein said overcoat layer has athickness of from about 1 to about 20 micrometers.

7. A method in accordance with claim 6, wherein said overcoat layer has a thickness of from about 3 to about 15 micrometers.

8. A method in accordance with claim 1, further comprising c) transferring said developed image from said photoreceptor surface to another member or a copy substrate via a transfer component.

9. A method in accordance with claim 8, further comprising d) fusing said developed image to a copy substrate via a fusing member.

* * * * *